US007607486B2

(12) United States Patent
Farquhar et al.

(10) Patent No.: US 7,607,486 B2
(45) Date of Patent: Oct. 27, 2009

(54) ONE TRIP TUBULAR EXPANSION AND RECESS FORMATION APPARATUS AND METHOD

(75) Inventors: Graham E. Farquhar, Turriff (GB); Robert C. Smith, Dyce (GB)

(73) Assignee: Baker hughes Incorporated, Houston, TX (US)

( * ) Notice: Subject to any disclaimer, the term of this patent is extended or adjusted under 35 U.S.C. 154(b) by 219 days.

(21) Appl. No.: 11/830,330

(22) Filed: Jul. 30, 2007

(65) Prior Publication Data

US 2009/0032266 A1 Feb. 5, 2009

(51) Int. Cl.
*E21B 43/10* (2006.01)

(52) U.S. Cl. ..... 166/380; 166/206; 166/216

(58) Field of Classification Search ..... 166/380, 166/206, 207, 216
See application file for complete search history.

(56) References Cited

U.S. PATENT DOCUMENTS

| | | | | |
|---|---|---|---|---|
| 6,325,148 | B1 * | 12/2001 | Trahan et al. | 166/297 |
| 6,352,112 | B1 | 3/2002 | Mills | |
| 6,450,261 | B1 * | 9/2002 | Baugh | 166/277 |
| 6,691,777 | B2 * | 2/2004 | Murray et al. | 166/216 |
| 6,880,632 | B2 | 4/2005 | Tom et al. | |
| 7,080,693 | B2 | 7/2006 | Walker et al. | |
| 7,128,146 | B2 | 10/2006 | Baugh et al. | |
| 2004/0055754 | A1 * | 3/2004 | MacKay et al. | 166/380 |
| 2004/0065445 | A1 * | 4/2004 | Abercrombie Simpson et al. | 166/382 |
| 2004/0159446 | A1 * | 8/2004 | Haugen et al. | 166/384 |
| 2004/0168808 | A1 * | 9/2004 | Smith | 166/313 |
| 2004/0226723 | A1 * | 11/2004 | Simpson | 166/380 |
| 2004/0251033 | A1 * | 12/2004 | Cameron et al. | 166/382 |
| 2005/0023001 | A1 * | 2/2005 | Hillis | 166/380 |
| 2005/0045342 | A1 * | 3/2005 | Luke et al. | 166/384 |
| 2005/0056433 | A1 * | 3/2005 | Ring et al. | 166/384 |
| 2005/0103502 | A1 * | 5/2005 | Watson et al. | 166/380 |
| 2005/0145390 | A1 * | 7/2005 | Burge | 166/380 |
| 2005/0150660 | A1 * | 7/2005 | Cook et al. | 166/380 |
| 2005/0161213 | A1 * | 7/2005 | Sonnier et al. | 166/207 |
| 2005/0161226 | A1 * | 7/2005 | Duggan et al. | 166/380 |
| 2006/0011340 | A1 * | 1/2006 | Smith et al. | 166/207 |
| 2006/0065408 | A1 * | 3/2006 | Green et al. | 166/384 |
| 2006/0175055 | A1 * | 8/2006 | Abdrakhmanov et al. | 166/207 |
| 2006/0225879 | A1 * | 10/2006 | Gano et al. | 166/207 |
| 2007/0034383 | A1 * | 2/2007 | Shuster et al. | 166/380 |
| 2007/0034408 | A1 * | 2/2007 | Benzie et al. | 175/57 |
| 2007/0158081 | A1 * | 7/2007 | Harrall et al. | 166/380 |
| 2007/0221374 | A1 * | 9/2007 | Filippov et al. | 166/207 |
| 2008/0142229 | A1 * | 6/2008 | Brisco et al. | 166/380 |
| 2008/0302540 | A1 * | 12/2008 | Farquhar et al. | 166/380 |

* cited by examiner

*Primary Examiner*—Shane Bomar
(74) *Attorney, Agent, or Firm*—Steve Rosenblatt

(57) ABSTRACT

A one trip top to bottom expansion to form a lower end recess on a tubular is described using two swages of different dimensions. The smaller swage is run down hole with the larger swage behind it in a locked collapsed position. When the proper depth is reached the leading swage hits a no go. A pickup force with dogs engaged in a groove releases the lock on the larger swage at which point applied pressure sets an anchor, extends the larger swage to take over the expansion for the recess at the lower end of the tubular. An emergency release is provided to pull out of the hole if the swage cannot complete the task.

19 Claims, 9 Drawing Sheets

ONE TRIP TUBULAR EXPANSION AND RECESS FORMATION APPARATUS AND METHOD

FIELD OF THE INVENTION

The field of this invention is tubular expansion downhole and more particularly two stage expansion to create a recess so one string can be expanded into another to create a monobore and even more particularly doing it in one trip in a downhole direction.

BACKGROUND OF THE INVENTION

Monobore completions result in a common diameter of the well from the surface using expansion techniques. Usually a string has a recess at its lower end representing a zone of enlarged diameter at its lower end. When that string is secured in position another string is run through it and the top end of the second string is placed in alignment with the recess at the lower end of the first string. An expansion device is then applied to the second string to make its inside diameter approximately the same as the inside diameter of the upper string. The two strings are secured to each other in the recess of the upper string. Because of the recess, the expansion of the lower string results in no internal dimension reduction in the overall assembled strings.

One way to do this is to mount a recess on the lower end of the upper string and expand the upper string to the recess and then put the lower string into position adjacent the recess of the upper string and expand the lower string. Another way is to form the recess downhole. One such technique is described in the July 2005 edition of World Oil article by Fischer and Snyder a technique of forming a bell at the bottom and then continuing liner expansion to the surface was described. This bottom up technique puts the tubular being expanded into compression and risks buckling during the expansion. What is needed and not provided by this technique is a way to expand from top to bottom with the string in tension and a simple technique of transitioning between swages after the tubular is expanded so that the recess can then be produced. This is more technically challenging to do than a bottom up expansion because in a top down expansion there has to be a swage transition to a bigger size within an expanded tubular to form the even larger recess. A technique of disabling the larger swage until the recess needs forming is also incorporated into the invention. Features are also provided for emergency release in case the expansion assembly cannot fully advance and needs to be pulled out of the hole to the surface. These and other advantages of the present invention will be more apparent to those skilled in the art from a review of the description of the preferred embodiment and the associated drawings while recognizing that the claims define the full scope of the invention.

SUMMARY OF THE INVENTION

A one trip top to bottom expansion to form a lower end recess on a tubular is described using two swages of different dimensions. The smaller swage is run down hole with the larger swage behind it in a locked collapsed position. When the proper depth is reached the leading swage hits an integral or releasable no go shoulder. A pickup force with dogs engaged in a groove releases the lock on the larger swage at which point applied pressure sets an anchor, extends the larger swage to take over the expansion for the recess at the lower end of the tubular. An emergency release is provided to pull out of the hole if the swage cannot complete the task.

BRIEF DESCRIPTION OF THE DRAWINGS

FIG. 13 is a perspective view of some of the components of the releasable no go showing the c-ring positions when the no go is locked in.

DETAILED DESCRIPTION OF THE PREFERRED EMBODIMENT

Figure 1:
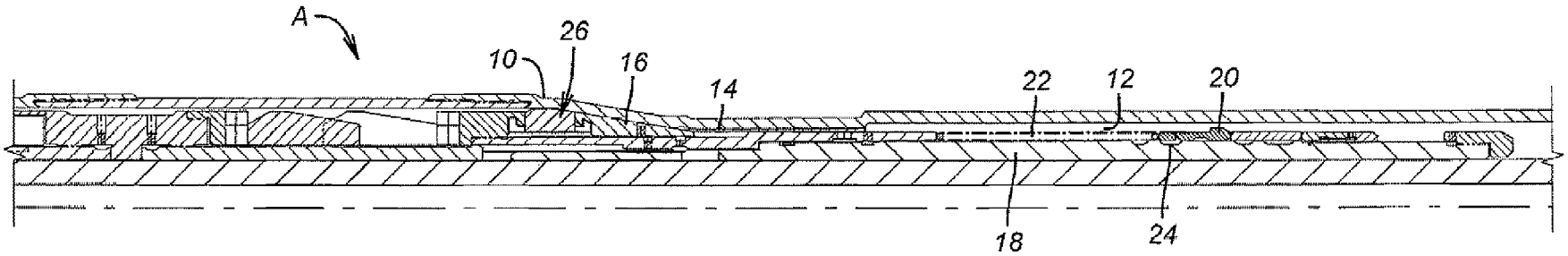
FIG. 1 is a section view showing the leading in the no-go position.

FIG. 1 illustrates the component positions for the initial top down expansion of a tubular 10. The tubular 10 preferably has a recess 12 below a restrictor 14. The purpose of restrictor 14 is to give an early signal at the surface that the leading fixed cone 16 is approaching the restrictor 14. FIG. 1 shows a mandrel 18 that supports a series of dogs 20 that are movable against the bias of spring 22. When the dogs 20 on the way downhole engage the restrictor 14, the mandrel keeps moving to compress spring 22 and present groove 24 opposite dogs 20 to allow them to radially retract and clear the restrictor 14, at which time spring 22 pushes dogs 20 out of groove 24 so that they again radially extend outwardly and far enough to be captured in recess 12, as shown in FIG. 2, when the assembly A is picked up again.

The components of the assembly A will now be described. Referring to FIG. 2, the leading cone 16 is preferably fixed. A variable diameter swage 26 has alternating segments only one 28 is seen in the section view because the segments are all in alignment. Segments 28 each have a lower retainer 30 that is engaged to the fixed cone 16. The other nested segments that can't be seen in the section view each have upper retainers 32 that are collectively pushed down by ring 34 when an anchor and associated stroker (both not shown) advance the mandrel 18 downhole. This occurs by getting the anchor to grip as pressure extends the stroke to advance a swage assembly. As retainers 30 and 32 are brought together by a downhole force, the segments fall into alignment on variable diameter swage 26 and make a continuous expansion circumferential surface 36 to expand the tubular 10.

Uphole of leading variable diameter swage 26 is a larger swage 38 of a similar design and shown in its extended or smaller diameter dimension. In the position shown in FIG. 2, alternating segments 40 and 42 are shown with their peaks 44 and 46 offset. Segments 40 have retainers 48 secured to ring 50. Segments 42 have retainers 52 secured to ring 34. Segments 40 can be aligned with segments 42 unless that movement is locked, as will be explained below. For initial expansion of the tubular 10, the fixed cone enters first and the force from the stroker supported by an anchor (both not shown) is enough to make the leading swage 26 get its segments 28 and their alternating segments that are not shown into alignment so that the maximum dimension of swage 26 represents the degree of the initial expansion of tubular 10.

Figure 2:
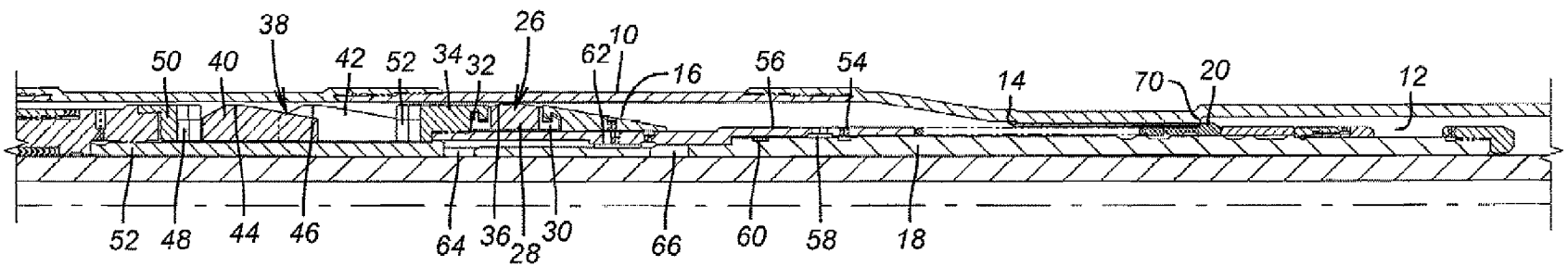
FIG. 2 is the view of FIG. 1 showing the dogs stopped against a shoulder recess.

During this initial expansion of tubular 10 the segments 40 and 42 are locked in the FIG. 2 position. C-ring 58 is a circlip. During the initial expansion ring 34 is prevented from moving because the body lock ring 58 transfers the load from sleeve 56 (attached to 34) directly to sleeve 52 thus by-passing the larger swage.

Figure 7:
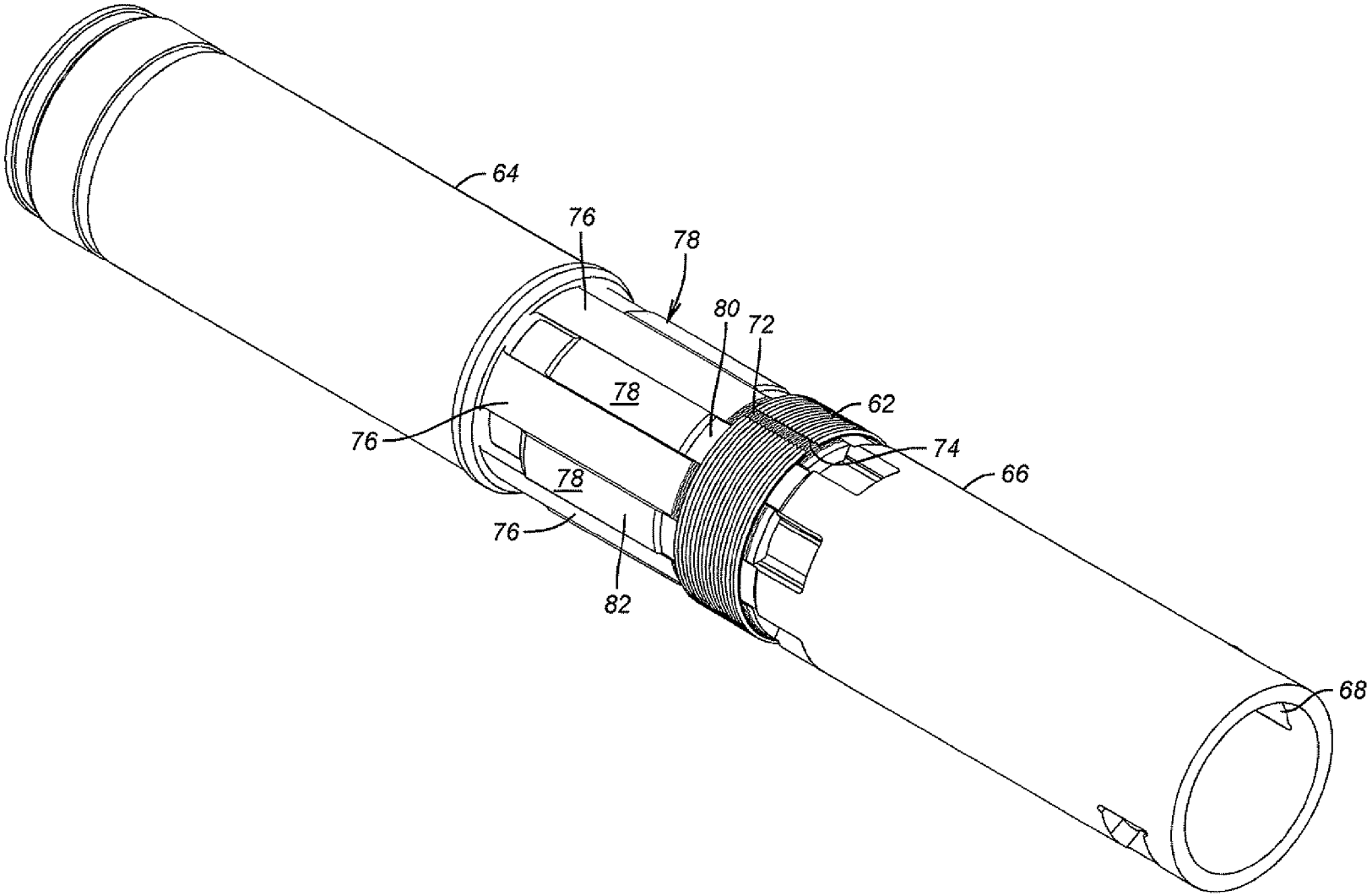
FIG. 7 is a perspective view of the lock for the trailing swage in the run in position as expansion takes place with the leading swage.
Figure 8:
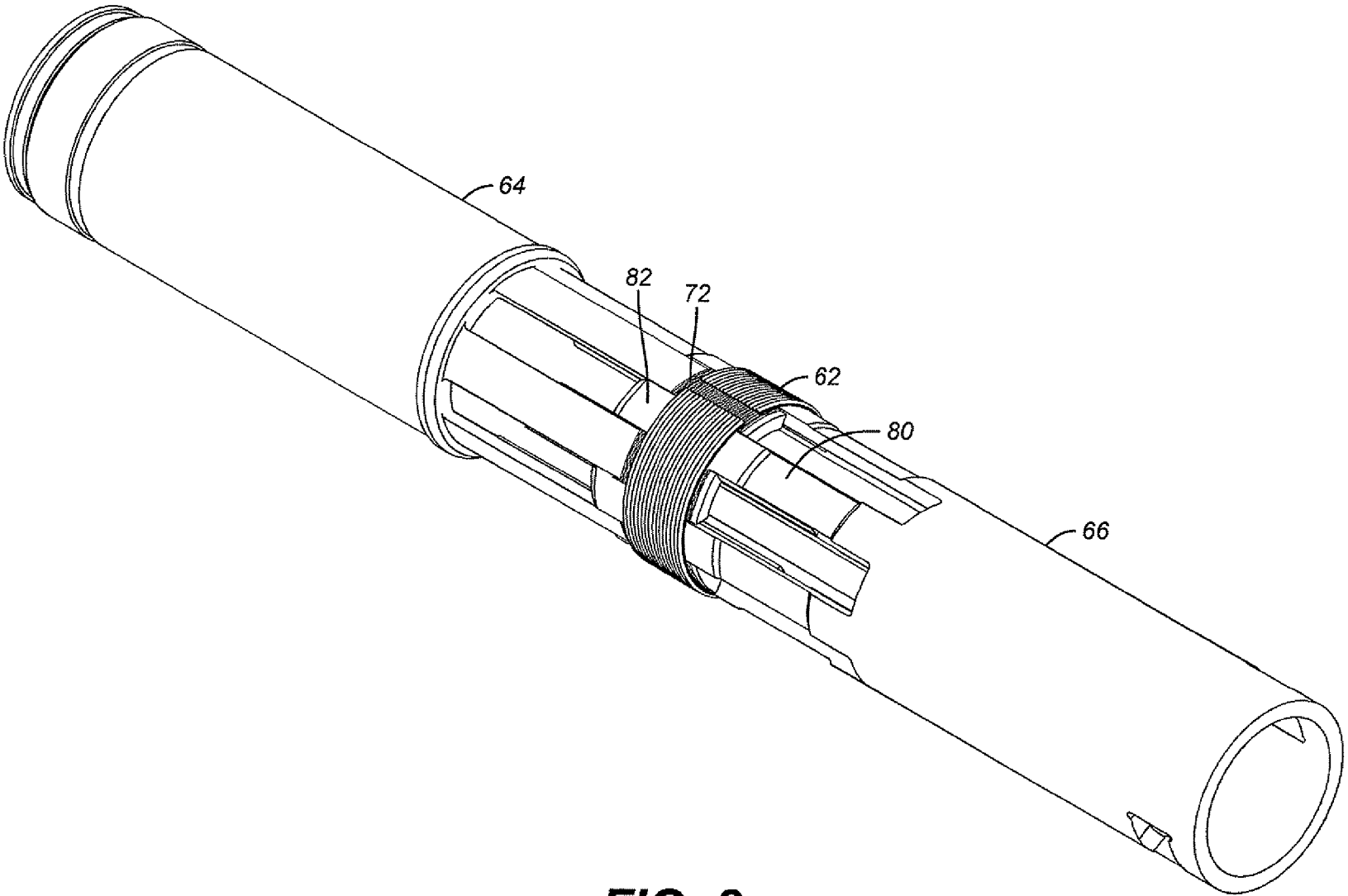
FIG. 8 is the view of FIG. 7 with the lock released so that the trailing swage can go to its full dimension on pressure application which strokes it further downhole.

Sleeve 56 carries c-ring 58 that is held radially spread out until it is moved into alignment with groove 60 on mandrel 18 at which point it locks the relative movement that created that alignment, as will later be discussed. A lock ring 62 in the FIG. 2 component position, locks sleeve 56 to sleeve 52 as the swage 26 is advanced to expand the tubular 10 initially. Mandrel 18 has a lost motion design that is better illustrated in FIGS. 7 and 8. Lock ring 62 initially holds sleeve 56 to sleeve 52. While FIGS. 7 and 8 are schematic, those skilled in the art will appreciate that dogs 20 shown in FIG. 2 can be designed to extend through windows 68 to engage shoulder 70 shown in FIG. 2. This engagement keeps component 66 from moving uphole while component 64 is pulled up. Component 64, which is the same part as sleeve 52 moves with sleeve 56 shown in FIG. 2 while component 66 is part of the mandrel 18 that is held by shoulder 70. Component 64 has wickers 72 which engage lock ring 62 on its underside leaving a relatively small gap 74 in lock ring 62. Wickers 72 are segmented and are disposed on fingers 76, three of which are shown in FIG. 7. Fingers 76 extend from segment 64 and move with it. Fingers 78 alternate with fingers 76 and extend from segment 66 which doesn't move due to dogs 20 engaged to surface 70 as shown in FIG. 2. Fingers 78 have a recess 80 which is initial alignment with wickers 72. Adjacent to recess 80 is a high section 82 that upon relative movement between segments 64 and 66 rides under ring 62 to lift it off wickers 72 as shown in FIG. 8. Once this position is attained, reversing the movement is possible without impediment from ring 62 to allow the segments 40 and 42 to go into alignment so that continuing expansion of tubular 10 can add the recess 84 (see FIG. 5) to the already expanded tubular 10.

Figure 3:
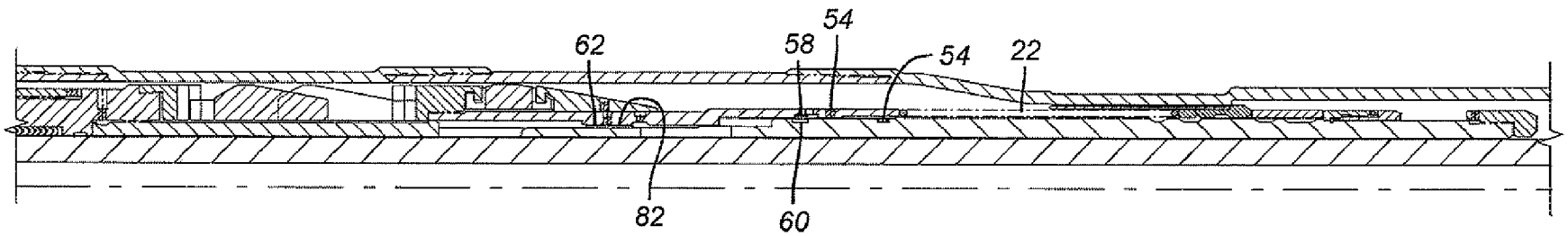
FIG. 3 is the view of FIG. 2 with the shear screws sheared to allow relative movement between mandrels.
Figure 4:
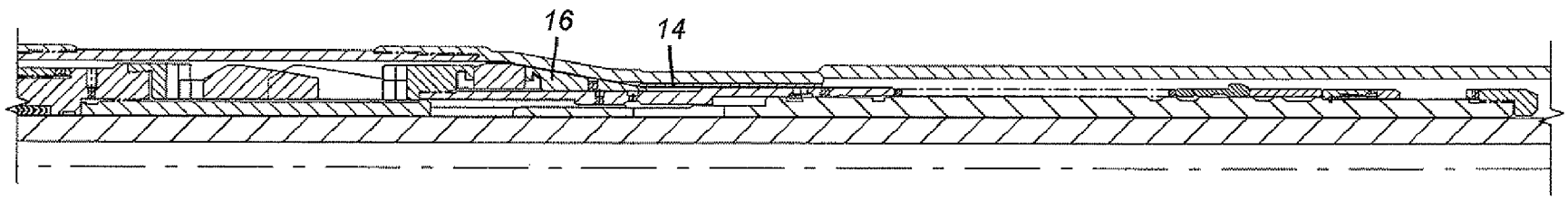
FIG. 4 is the view of FIG. 3 with the leading swage bottomed on the no go and the trailing swage released to get bigger on application of pressure in the string.
Figure 5:
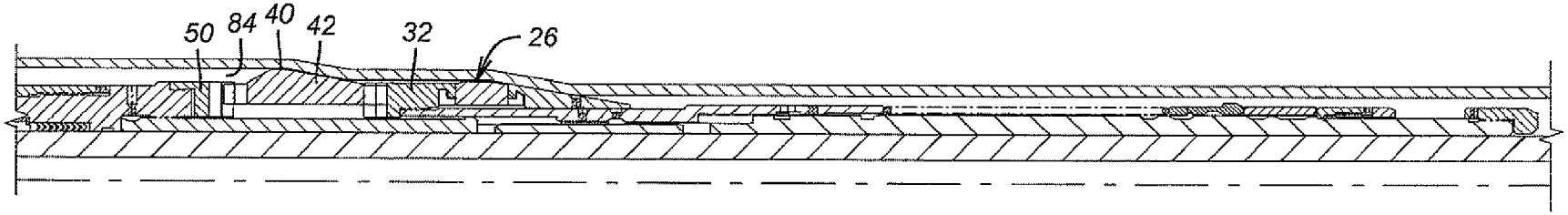
FIG. 5 is the view of FIG. 4 with the trailing swage actuated to form the recess.
Figure 6:
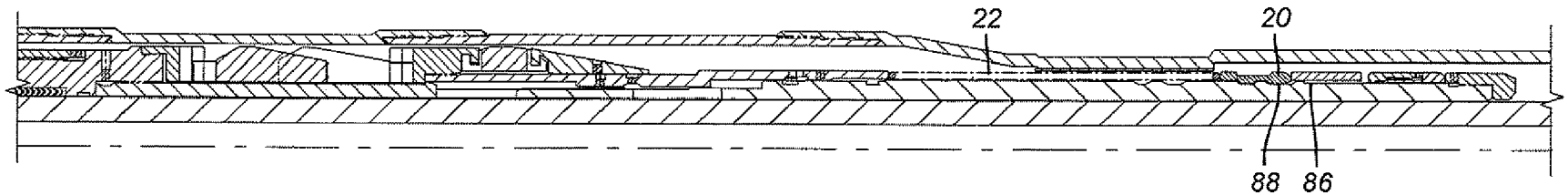
FIG. 6 is the view of FIG. 5 in the emergency release position where the trailing swage is collapsed.

The operational sequence can now be better understood with a sequential look at the FIGS. 1-5. In FIG. 1 the dogs 20 have jumped past restrictor 14 to give a signal at the surface that the dogs are in recess 12 and that very soon the fixed cone 16 will bottom out on restrictor 14. At that point further expansion with swage 26 is halted and the assembly is picked up to the FIG. 2 position with dogs 20 up against shoulder 70. At that point an upward pull from the surface moves sleeve 56 uphole relative to the portion of mandrel 18 held by the dogs 20. The result is that shear pin 54 breaks and c-ring 58 lines up with groove 60 and snaps into it preventing further relative movement that just occurred in either direction. This position is shown in FIG. 3 which also shows spring 22 has extended. That same relative movement no locked in by c-ring 58 has also resulted in bringing high sections 82 under lock ring 62, as shown in FIG. 8 so that lock ring 62 no longer engages wickers 72 below it. This is also shown in FIG. 3. FIG. 4 shows weight set down again until cone 16 lands on restrictor 14. Form this point when the anchor and stroker (both not shown) are activated relative movement is now possible between rings 50 and 34 so as to put segments 40 and 42 into alignment to expand tubular 10 to a larger dimension than with swage 26 as shown in FIG. 5. Because the high sections 82 separate lock ring 62 from wickers 72, swage 38 can now be activated to a larger dimension whereupon further expansion with swage 38 can make the recess 84. After coming out the bottom of the tubular 20 the pressure that set the anchor and operated the stroker is removed and a pickup force allows swage 38 and 26 to extend and radially collapse so that the assembly A can be withdrawn.

If an emergency release is needed when dogs 20 are still in a position to hang in recess 12 a pickup force is applied to shear shear ring 86 which in turn allows spring 22 to push down dogs 20 into groove 88 and once there they can clear the restrictor 14 to allow the assembly A to be pulled out of the hole.

Figure 9:
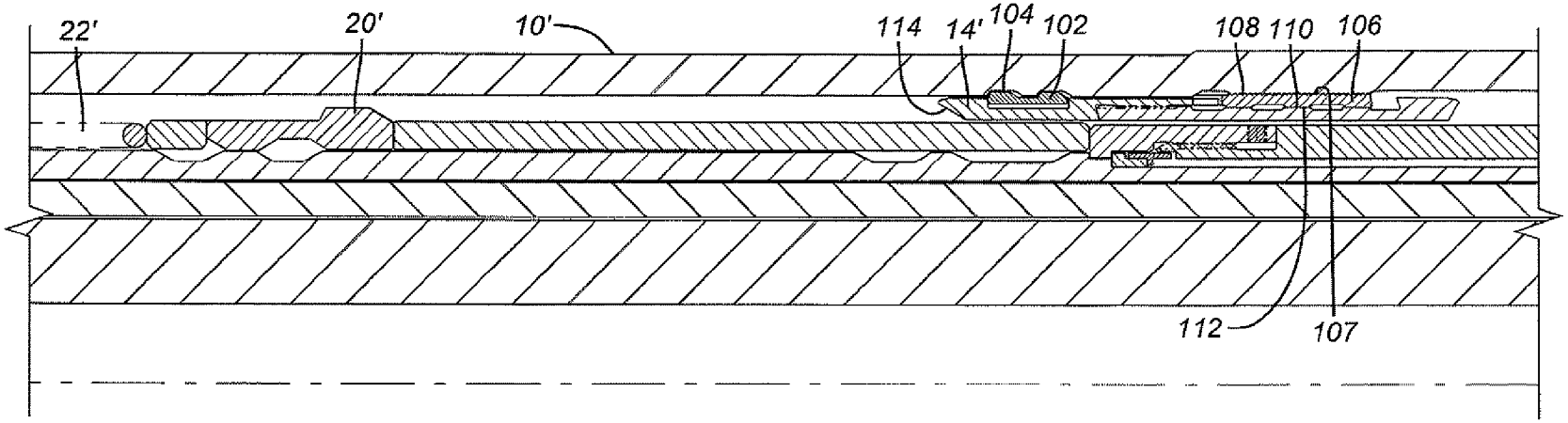
FIG. 9 is a sectional detailed view of a releasable no go locked in position and before it is engaged by the swage assembly.
Figure 10:
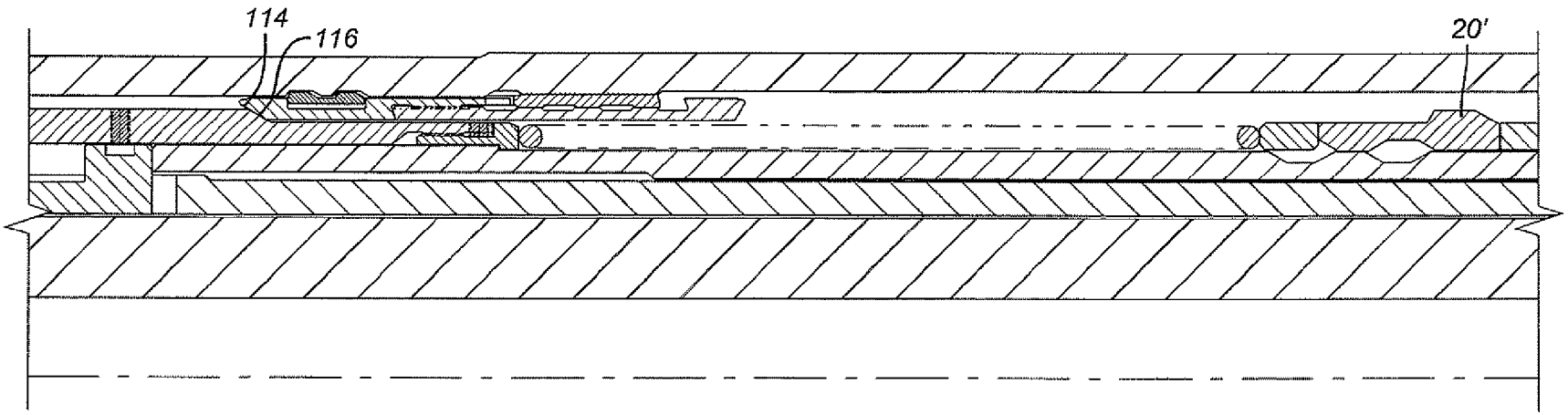
FIG. 10 is the view of FIG. 9 with the releasable no go engaged by the swage assembly.
Figure 11:
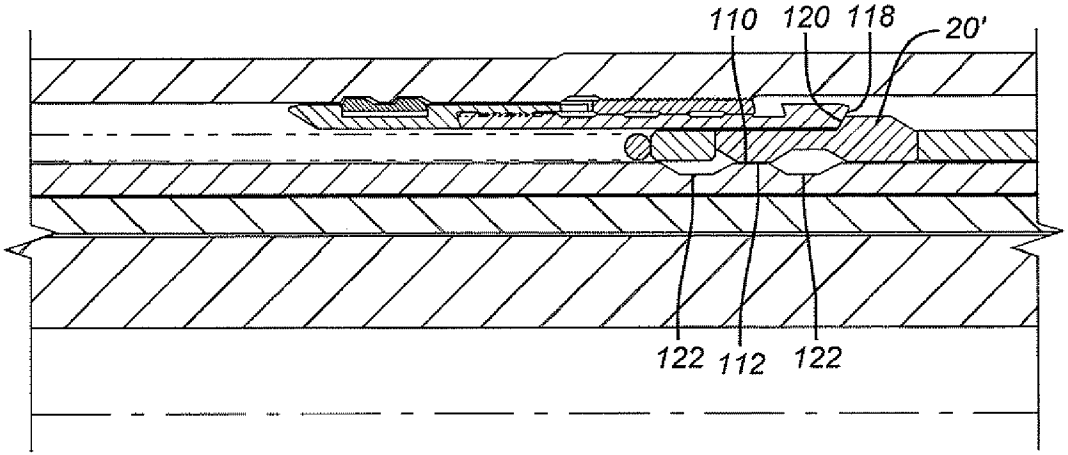
FIG. 11 is the view of FIG. 10 with the releasable no go engaged from below and just before its release.
Figure 12:
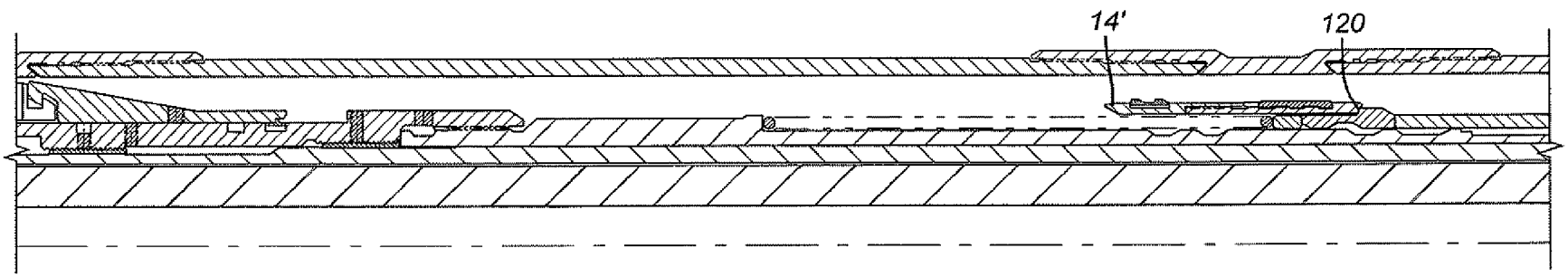
FIG. 12 is the view of FIG. 11 with the releasable no go fully released.
Figure 13:
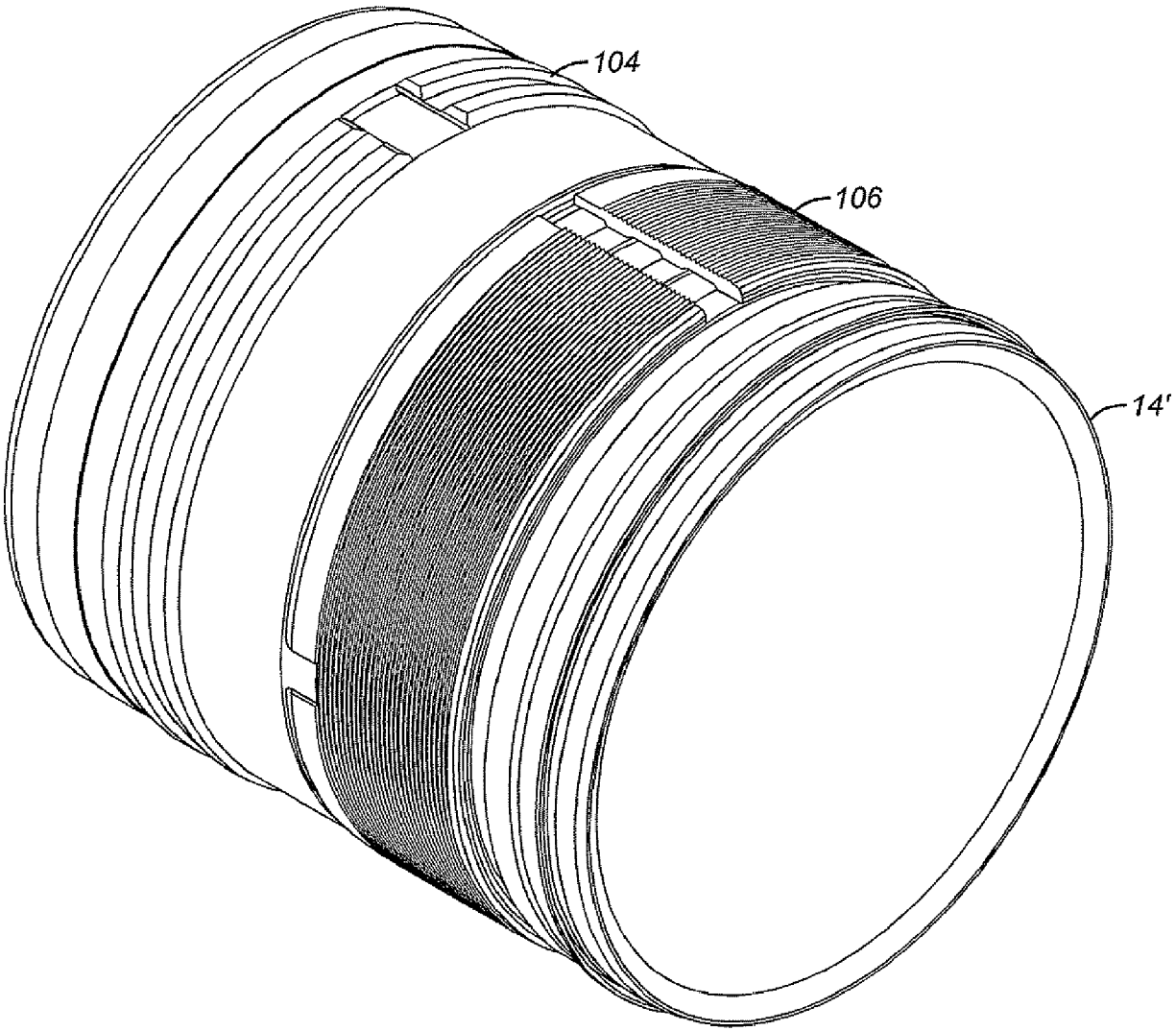
Figure 14:
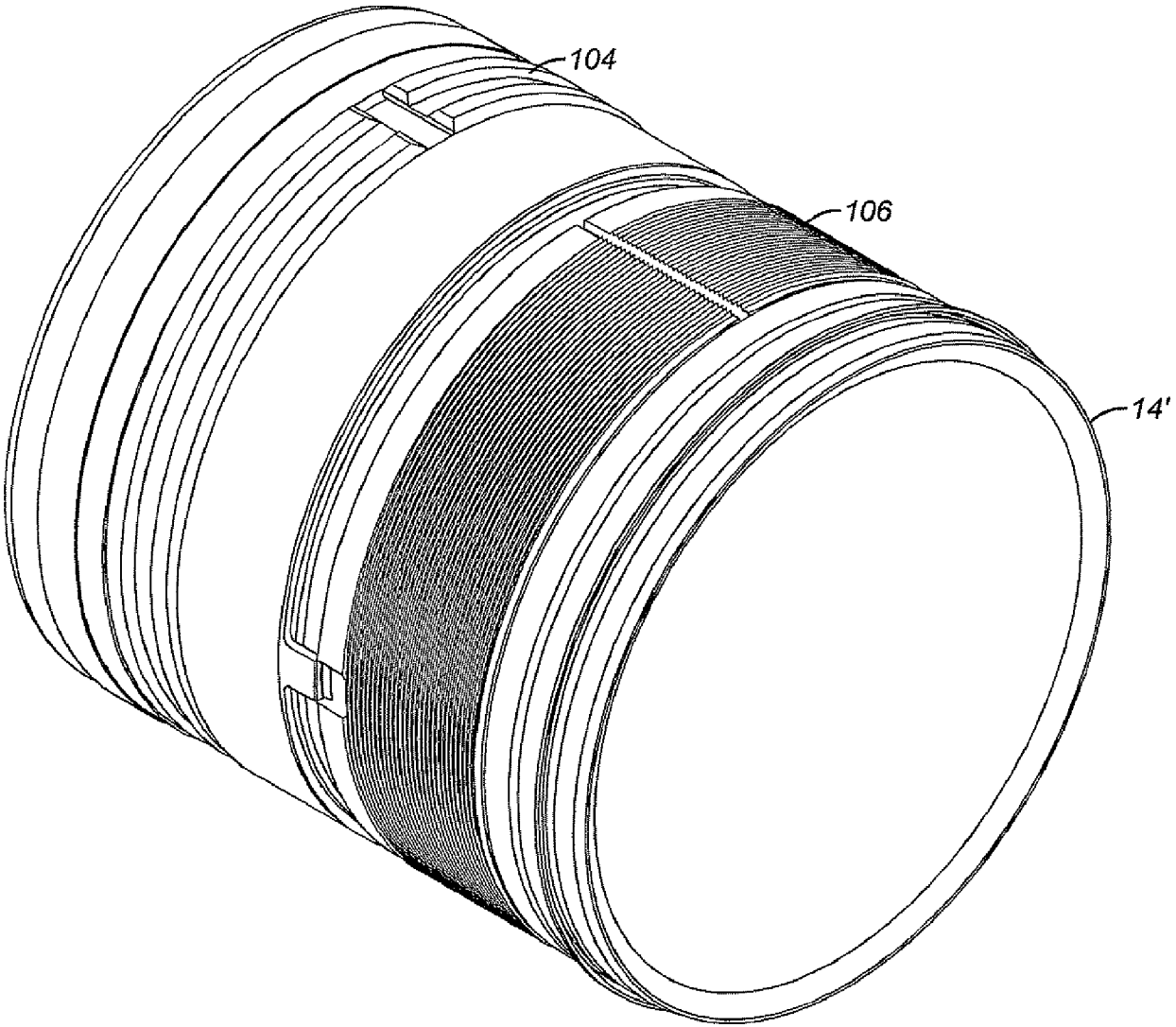
FIG. 14 is the view of FIG. 13 showing the c-rings collapsed for release of the releasable no go.

While FIGS. 1-8 showed a fixed restrictor 14 a removable design is illustrated in FIGS. 9-14. Restrictor 14' has a groove 100 in which sits a locator split ring 102 shown having a pair of circumferential projections that can spring into a matching pattern of depressions 104 in tubular 10'. Ring 102 locates restrictor 14' while the location is locked with split lock ring 106 having wickers 107 that engage wickers 108 on tubular 10' when humps 110 engage humps 112. FIG. 9 shows dogs 20' approaching stop surface 114. FIG. 10 shows dogs 20' having jumped past surface 114 and taper 116 landed on that surface. Taper 116 in this embodiment is slightly in advance of the fixed cone 16 shown in FIGS. 1-8. FIG. 11 shows tapered surface 120 of dogs 20' engaging tapered surface 118 at the lower end of the removable restrictor 14'. Any further uphole movement of dogs 20' from the FIG. 11 position will result in the FIG. 12 position where humps 110 and 112 get into misalignment as shown in FIG. 12 rather than the alignment shown in FIG. 11. In essence hump 110 falls into groove 122 and the restrictor 14' is captured on shoulder 120 for removal from the tubular 10' as shown in FIG. 12. FIGS. 13 and 14 show the relative movement within restrictor 14' that locks it to tubular 10' in FIG. 13 and releases it in FIG. 14 as well as the c-ring preferred shape of rings 104 and 106.

The above description is illustrative of the preferred embodiment and many modifications may be made by those skilled in the art without departing from the invention whose scope is to be determined from the literal and equivalent scope of the claims below.

We claim:

1. A method of creating a recess fully located at the lower end of a tubular string having an initial rounded internal diameter to accept another string to be expanded into the recess, comprising:

running in an expansion assembly into the string;

using a leading swage to expand said initial rounded internal diameter of the string as the assembly advances into the string;

releasing a trailing swage after said expansion with said leading swage; and continuing expansion of the string to a larger size than said leading swage with said following swage moving in the same direction as said leading swage to form the recess adjacent the lower end of the string.

2. The method of claim 1, comprising:

locking said trailing swage in a dimension smaller than said leading swage as said leading swage substantially expands the tubular string.

3. The method of claim 2, comprising:

unlocking said trailing swage to change in size after substantial expansion of the tubular string.

4. The method of claim 3, comprising:

selectively engaging the assembly to the tubular string to perform said unlocking.

5. The method of claim 4, comprising:

applying a force to said assembly while engaged to the tubular string.

6. The method of claim 5, comprising:

locking said trailing swage to a mandrel;

undermining locking of said trailing swage to said mandrel from said applied force.

7. The method of claim 6, comprising:

disabling a locking member by radial dimension change thereof.

8. The method of claim 7, comprising:

running a ramp against said locking member to change its dimension radially.

9. The method of claim 8, comprising:

using a split ring as said locking member.

10. The method of claim 9, comprising:

providing serrations on at least one of an inner and outer face of said split ring;

removing contact of said serrations by running said ramp within said split ring.

11. The method of claim 10, comprising:

applying force to said trailing swage after said unlocking to increase its dimension to larger than said leading swage.

12. The method of claim 4, comprising:

using a restriction in said tubular string to provide a surface signal to the surface that the leading swage is near the portion of the tubular string where the assembly can be engaged.

13. The method of claim 12, comprising:

making the restriction removable.

14. The method of claim 12, comprising:

providing a collet recess in the string for a spring loaded collet on said assembly to selectively engage.

15. The method of claim 14, comprising:

breaking at least one shear pin by applying a force to said collet when said collet is retained by the tubular string.

16. The method of claim 15, comprising:

breaking said shear pin which unlocks said trailing swage to change radial dimension to a dimension larger than said leading swage.

17. The method of claim 16, comprising:

providing an up front fixed diameter swage ahead of said leading swage.

18. The method of claim 13, comprising:

reducing resistance to expansion by removal of said restriction.

19. The method of claim 13, comprising:

reducing the amount of inside diameter expansion by removal of said restriction.

* * * * *